US006684452B2

(12) United States Patent
Lehman et al.

(10) Patent No.: US 6,684,452 B2
(45) Date of Patent: Feb. 3, 2004

(54) DUAL CLEANING MODE CARPET EXTRACTOR

(75) Inventors: Dexter Lehman, Buffalo, MN (US); Nick Graupe, White Bear Lake, MN (US); Agnes Friese, Copenhagen (DK)

(73) Assignee: Nilfisk-Advance, Inc., Plymouth, MN (US)

( * ) Notice: Subject to any disclaimer, the term of this patent is extended or adjusted under 35 U.S.C. 154(b) by 0 days.

(21) Appl. No.: 09/982,124

(22) Filed: Oct. 17, 2001

(65) Prior Publication Data

US 2003/0070249 A1 Apr. 17, 2003

(51) Int. Cl.[7] ..... A47L 11/30

(52) U.S. Cl. ..... 15/320; 15/340.2; 15/340.3; 134/21

(58) Field of Search ..... 15/320, 322, 401, 15/340.2, 340.3; 134/21

(56) References Cited

U.S. PATENT DOCUMENTS

| | | | | |
|---|---|---|---|---|
| 2,558,590 A | * | 6/1951 | Smith | 15/320 |
| 3,065,490 A | | 11/1962 | Arones | 15/401 |
| 3,931,662 A | * | 1/1976 | Nayfa et al. | 15/320 |
| 3,942,214 A | | 3/1976 | Maasberg | 15/320 |
| 4,173,056 A | | 11/1979 | Geyer | 15/320 |
| 4,620,341 A | | 11/1986 | Rigby | 15/339 |
| 4,817,233 A | | 4/1989 | Waldhauser | 15/320 |
| 4,953,254 A | | 9/1990 | Kohl et al. | 15/320 |
| 5,265,300 A | | 11/1993 | O'Hara et al. | 15/320 |
| 5,309,592 A | | 5/1994 | Hiratsuka | 15/319 |
| 5,319,828 A | | 6/1994 | Waldhauser et al. | 15/320 |
| 5,465,456 A | | 11/1995 | Fellhauer et al. | 15/320 |
| 5,524,320 A | | 6/1996 | Zachhuber | 15/320 |
| 5,611,106 A | | 3/1997 | Wulff | 15/320 |
| 5,901,410 A | | 5/1999 | Windmeisser | 15/354 |
| 5,933,911 A | | 8/1999 | Windmeisser | 15/320 |
| 5,970,571 A | | 10/1999 | Ochss | 15/320 |
| 6,061,868 A | | 5/2000 | Moritsch et al. | 15/320 |
| 6,247,202 B1 | * | 6/2001 | Lesco et al. | 15/320 |

FOREIGN PATENT DOCUMENTS

| | | |
|---|---|---|
| GB | 486499 | 6/1938 |

* cited by examiner

*Primary Examiner*—Theresa T. Snider
(74) *Attorney, Agent, or Firm*—Alan Kamrath; Rider Bennett, LLP

(57) ABSTRACT

A carpet extractor (10) operable in either a restorative cleaning mode or a maintenance cleaning mode includes a constant rate pump (96) which dispenses clean solution through a manually operated valve (98) to one of two lines (100, 102) having nozzles which restrict dispensing to high and low solution flow rates. In the preferred form, clean solution is dispensed at the high flow rate directly upon the carpeted surface and at the low rate upon the agitating brush (88). When restorative cleaning is desired, the valve (98) is manually moved to dispense at the high flow rate and a switch (110) is also manually moved resulting in the chassis (18) being propelled at a slow working speed. When maintenance cleaning is desired, the valve (98) is manually moved to dispense at the low flow rate and the switch (110) is also manually moved resulting in the chassis (18) being propelled at a fast working speed.

12 Claims, 1 Drawing Sheet

DUAL CLEANING MODE CARPET EXTRACTOR

BACKGROUND OF THE INVENTION

The present invention generally relates to apparatus for cleaning floor surfaces, particularly to floor surface cleaning apparatus which applies cleaning solution to the floor surface and then vacuums the soiled cleaning solution from the floor surface, more particularly to carpet extractors, and specifically to carpet extractors having the ability to do both restorative cleaning and maintenance cleaning of carpeted surfaces.

The most common method of cleaning carpeted surfaces is with a carpet extractor. These machines consist of a clean solution tank with some means to apply solution to the floor surface, an agitation means for cleaning the floor surface, a dirty solution tank, and a vacuum means to pick the dirty solution off the floor surface after it is agitated. The tanks and systems performing these operations are usually attached to and carried by some type of chassis, which also may have provisions for a power source, wheels, and a means to transport the machine.

There are two types of carpet extraction, restorative and maintenance. Restorative cleaning is a deep cleaning process that is performed to remove soil and stains that normal dry vacuuming can not. Restorative cleaning requires a relatively high volume of solution to wash and flush soil and stains from deep within the carpeted surface. One of the negatives of restorative cleaning is the amount of cleaning solution that is retained within the carpet fibers and backing when the process is completed. Until the retained solution evaporates from the surface, the carpeted surface typically is not used, as soil that comes in contact with the carpeted surface while it is damp tends to stick to the surface.

Maintenance cleaning involves a cleaning of the upper exterior of the carpeted surface only. Maintenance cleaning requires a relatively low volume of solution resulting in less residual solution left in the carpeted surface and a shorter dry time.

Prior to the present invention, carpet extractors have been set up to do either maintenance cleaning or restorative cleaning. Since the solution typically is dispensed at a fixed rate, the only way to vary the amount of solution applied to a given area of carpeted surface was by varying the speed of the machine.

Thus, a need exists for floor surface cleaning apparatus which is selectively operative in one of two cleaning modes, and in the preferred form, restorative and maintenance carpet extraction.

SUMMARY OF THE INVENTION

The present invention solves this need and other problems in the field of floor surface cleaning apparatus and methods by providing, in the preferred form, the selection of dispensing of clean solution to a carpeted surface between high and low solution flow rates, with the carpeted surface with the dispensed clean solution being agitated, and then the solution is picked up off the carpeted surface after the carpeted surface has been agitated. The working speed of these operations is also selected between a slow working speed and a fast working speed. Thus, the carpeted surface can be restorative or maintenance cleaned depending upon the selection of the high and low solution flow rates and the slow and fast working speeds.

In preferred aspects, the flow rate selection is accomplished by valving flow from a constant rate pump between first and second dispensing lines having flow rated nozzles. Further, the clean solution as dispensed upon the carpeted surface at the high solution flow rate and upon the agitator at the low solution flow rate in the preferred form.

It is thus an object of the present invention to provide novel surface cleaning apparatus and methods.

It is further an object of the present invention to provide such novel surface cleaning apparatus and methods for carpeted surfaces.

It is further an object of the present invention to provide such novel surface cleaning apparatus and methods operative in either restorative and maintenance cleaning modes.

It is further an object of the present invention to provide such novel surface cleaning apparatus and methods providing selection between high and low solution dispensing rates.

It is further an object of the present invention to provide such novel surface cleaning apparatus and methods providing selection between where the clean solution is dispensed.

It is further an object of the present invention to provide such novel surface cleaning apparatus and methods providing selection between slow and fast working speeds.

It is further an object of the present invention to provide such novel surface cleaning apparatus and methods minimizing costs and complexities and maximizing cleaning choices.

These and other objects and advantages of the present invention will become clearer in light of the following detailed description of an illustrative embodiment of this invention described in connection with the drawings.

BRIEF DESCRIPTION OF THE DRAWINGS

The illustrative embodiment may best be described by reference to the accompanying drawings where.

Figure 1:
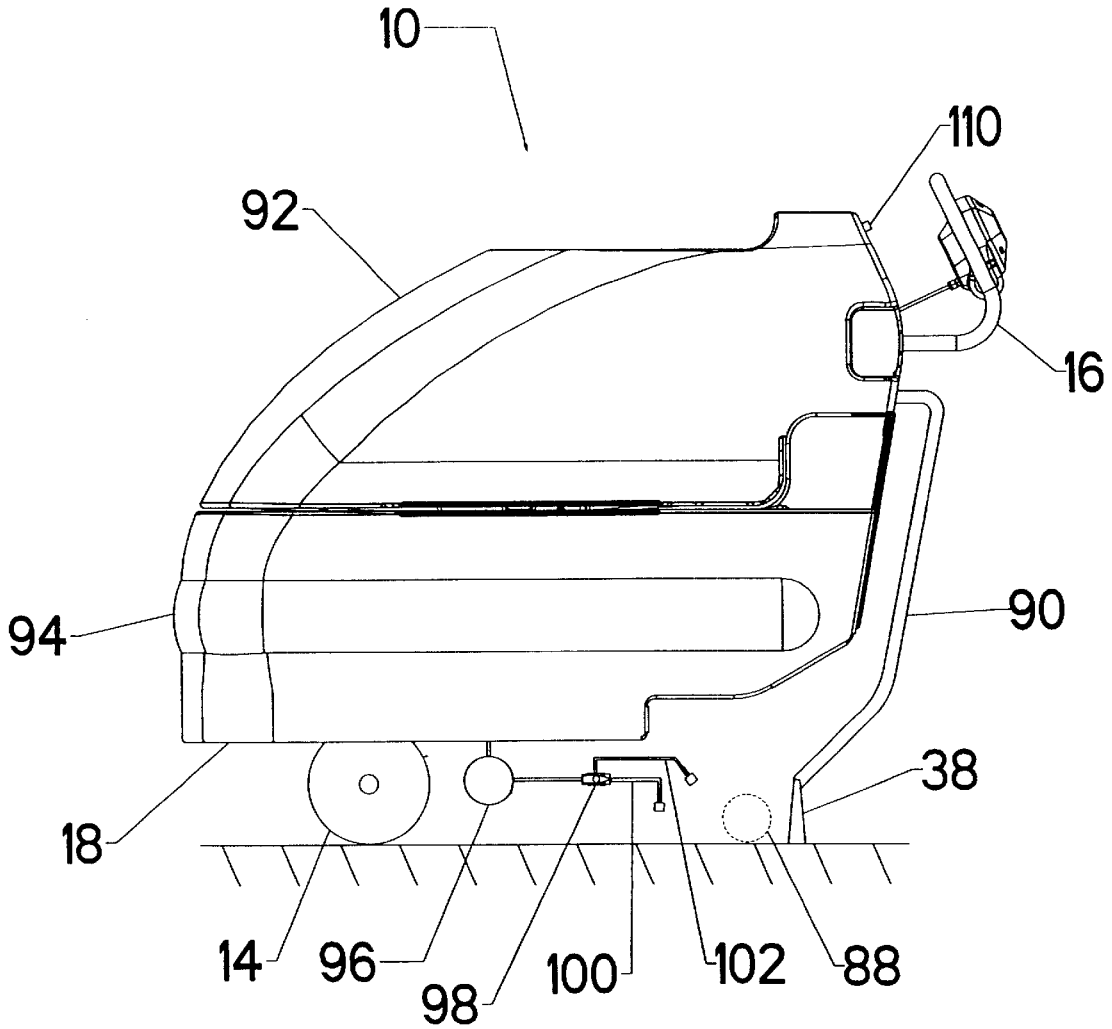
FIG. 1 shows a diagrammatic view of a dual cleaning mode carpet extractor fabricated in accordance with the preferred teachings of the present invention.

The figure is drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the figure of the drawings, the same numerals designate the same or similar parts. Furthermore, when the terms "first", "second", "forward", "behind", and similar terms are used herein, it should be understood that these terms have reference only to the structure shown in the drawings as it would appear to a person viewing the drawings and are utilized only to facilitate describing the preferred embodiment.

DETAILED DESCRIPTION OF THE PREFERRED EMBODIMENT

Apparatus in the form of a carpet extractor for cleaning floor surfaces and most preferably carpeted surfaces and for applying a cleaning solution to the floor surface and for extracting the soiled solution from the floor surface is shown in the drawings and generally designated 10. Generally, apparatus 10 includes a chassis 18 which is suitably movably supported on the floor surface such as by wheels 14, casters, rollers, or the like or combinations thereof. Chassis 18 is propelled upon the floor surface such as by having one or more wheels 14 being driven. In particular, wheels 14 could be driven by an electric motor in any manner including but not limited to of a conventional manner. In this regard, a suitable power source must be provided for such drive system as well as other components which need power, with many forms of apparatus 10 utilizing batteries as the power source. However, internal combustion engines, AC current motors, or the like could be utilized, if desired.

According to the teachings of the present invention, chassis 18 is capable of being propelled upon the floor surface at either first or second working speeds in the preferred form by driving wheel 14 at one of the first and second working speeds. Propulsion of chassis 18 at different working speeds can be accomplished in different manners according to the teachings of the present invention including but not limited to the use of a two speed transmission, providing different amperage levels to an electric drive motor or the like. The first, slow working speed is slower than the second, fast working speed.

In the preferred form shown, apparatus 10 is of the walk behind type and includes a handle 16 for manipulation by the operator walking adjacent chassis 18. However, it is contemplated that the present invention may have application with other types including but not limited to where the operator rides on or is pulled by apparatus 10.

Apparatus 10 according to the preferred teachings of the present invention generally includes an agitator for agitating carpeted surfaces shown in the most preferred form as a cylindrical brush 88 for engagement with the floor surface and which is rotated about an axis parallel to and spaced from the carpeted surface by any suitable means. Brush 88 is suitably carried by chassis 18 possibly including provisions for movement relative thereto between working and transport positions and in the preferred form includes suitable provisions as are well known in the art to allow ease of removal and replacement.

Apparatus 10 according to the preferred teachings of the present invention includes a vacuum shoe 38 such as of the type utilized to extract soiled solution from soft floor surfaces such as carpet, with shoe 38 being of a generally rigid construction of a triangular shape in the most preferred form. Vacuum shoe 38 is suitably carried by chassis 18 and possibly including provisions for movement relative thereto between working and transport positions and is positioned at least behind cylindrical brush 88 when apparatus 10 moves in a forward direction.

Cylindrical brush 88 and vacuum shoe 38 are suitably mounted to chassis 18 either together or separately for movement between a transport position and a working position. Typically, in the transport position, brush 88 and vacuum shoe 38 are spaced from the floor surface. In the working position, brush 88 and vacuum shoe 38 engage the floor surface, with suitable provisions to allow brush 88 and vacuum shoe 38 to follow the contour of the floor surface as apparatus 10 is moved along the floor surface and to maintain the desired pressure by brush 88 and vacuum shoe 38 upon the floor surface.

Apparatus 10 further includes a hose 90 for removable securement to vacuum shoe 38 and in fluid communication with a dirty solution storage tank 92. Storage tank 92 is carried by chassis 18 and is placed under vacuum such as by a fan powered by a suitable motor to draw air in from storage tank 92. Thus, the solution is picked up off the floor surface after the floor surface has been agitated by brush 88.

Apparatus 10 further includes a supply tank 94 for containing clean solution and carried by chassis 18. A pump 96 draws cleaning solution from supply tank 94 and applies the cleaning solution to the floor surface such that the floor surface including the dispensed clean solution is agitated by brush 88. In the most preferred form, a valve 98 is provided in the cleaning solution delivery line so that cleaning solution is capable of being dispensed to the carpeted surface at a first high solution flow rate for restorative cleaning and at a second low solution flow rate for maintenance cleaning. The high solution flow rate is greater than the low solution flow rate. In the preferred form, valve 98 is manually operated and in particular, valve 98 itself is rotated by the fingers of the operator between the high and low solution flow rates. Such manually operated valve 98 is less expensive than electrically operated valves and reduces the costs and complexity of the electrical controls necessary for apparatus 10. In the most preferred form, valve 98 receives clean solution from pump 96 and valves and directs the flow of cleaning solution between a first dispensing line 100 and a second dispensing line 102.

In particular and in the preferred form, line 100 includes one or more restorative nozzles which are less restrictive and allow a high solution flow rate (approximately 1 gallon or 3.75 liters per minute). The restorative nozzles direct the solution spray pattern, with force, directly at the carpet a few inches or centimeters before or in front of brush 88, allowing for saturation of the carpet before brush 88 agitates the carpeted surface and the fibers thereof, creating a deep cleaning. Positioning the restorative nozzle before brush 88 provides added time for the cleaning solution to totally saturate the carpet fibers and backing, thereby giving particles within the carpet fibers time to become part of the cleaning solution before it is picked up by vacuum shoe 38.

Line 102 includes one or more maintenance nozzles. The maintenance nozzles are more restrictive and allow a low solution flow rate (approximately ⅓ gallon or 1.25 liters per minute). The maintenance nozzles direct the solution spray pattern at an angle to the floor directly at brush 88 which is rotating. In the most preferred form, the maintenance nozzles direct the solution spray pattern at an angle in the order of 30° to 45° to the floor surface in front of brush 88 rotating towards the floor surface. Thus, the bristles of brush 88 are arranged with their free ends located closer to the floor surface than the axis of brush 88 and moving towards the floor surface when the solution spray pattern engages the back of the bristles of brush 88 to minimize undesired splashing of the solution and to maintain misting of the solution within acceptable ranges. When the cleaning solution is directed onto or dispensed upon brush 88, brush 88 introduces the solution to the carpeted surface so that the contact time between the solution and the carpet is shortened so that the solution does not sink into the carpet fibers before it is picked up by vacuum shoe 38. In particular, the cleaning solution is sprayed upon brush 88 which is then wetted at a location above the carpeted surface. As the wetted brush 88 rotates to engage the carpeted surface, the carpeted surface is then wetted by contact with the wetted brush 88 rather than direct contact with the clean solution spray. Also, it is possible for engagement with brush 88 which is rotating to mist the clean solution around brush 88. The net effect is the contact time between the clean solution and the carpeted surface is shortened so that the solution does not sink into the carpeted surface. Additionally, especially where brush 88 is within an enclosure, clean solution is directed only within the width of brush 88 which is narrower than vacuum shoe 38, which insures better recovery of the solution by vacuum shoe 38.

In the most preferred form, pump 96 operates at a constant rate and may include an unloader valve which allows cleaning solution to bypass pump 96 in the event that pressure in the cleaning solution delivery line exceeds a set amount. The different rates of delivery are accomplished by selection of the type of nozzles for lines 100 and 102 by operation of valve 98 rather than changing the operating parameters of pump 96. However, delivery of differing rates of cleaning solution can be accomplished by different manners according to the teachings of the present invention.

Apparatus 10 according to the preferred teachings of the present invention includes provisions 110 such as a switch for selecting whether chassis 18 should to be propelled upon the floor surface at one of the first and second working speeds. Switch 110 in the preferred form is independent of the operation and position of valve 98 and is manually actuated in the preferred form such as by moving a dial, a lever, or the like. It is also possible that switch 110 allows chassis 18 to be propelled at other speeds including at a transport speed which is faster than the working speeds. Working speeds do not necessarily reflect a single set speed but rather could include a distinct range of speeds, with it being possible to further refine the speed that chassis 18 is propelled preferably by further provisions separate from switch 110.

A lower working speed of apparatus 10 increases the amount of solution dispensed to a given area of the carpet and increases the dwell time of the solution with the carpet. Thus, if valve 98 directs cleaning solution to line 100 and if switch 110 causes apparatus 10 to be propelled at the first working speed, the result is a deeply cleaned carpet. A higher working speed of apparatus 10 decreases the amount of solution dispensed to a given area of the carpet and reduces the dwell time of the solution on the carpet. Thus, if valve 98 directs cleaning solution to line 102 and if switch 110 causes apparatus 10 to be propelled at the second working speed, the result is a carpet that is surface cleaned with less solution remaining in the carpet fibers and backing. Reducing the amount of remaining solution decreases the drying time of the carpet, allowing the carpeted area to be used sooner without risk of resoiling.

Now that the basic teachings of the present invention have been explained, many extensions and variations will be obvious to one having ordinary skill in the art. For example, the various components including but not limited to tanks 92 and 94, vacuum shoe 38, brush 88, chassis 18, and wheels 14 can have a variety of shapes and configurations according to the teachings of the present invention. In this regard, vacuum shoe 38 could be located at the front of chassis 18 and apparatus 10 propelled with the operator in front of apparatus 20 rather than in behind. Likewise, brush 88 could be of the rotary disk type. The drive wheel 14 could be located behind vacuum shoe 38. Tanks 92 and 94 could have a variety of arrangements such as on top or beside each other, be divided by a flexible or movable wall, or the like. The arrangement and configuration of components can be of infinite choices utilizing the methods according to the teachings of the present invention.

Although valve 98 is manually operated and independent from switch 110 which is manually actuated and is believed to be advantageous in minimizing costs and complexity and in maximizing cleaning choices, other manners of selection can be utilized according to the teachings of the present invention. As an example, valve 98 and switch 110 could be tied together such that when valve 98 results in dispensing at the high solution flow rate, chassis 18 is propelled at the slow working speed and when valve 98 results in dispensing at the low solution flow rate, chassis 18 is propelled at the fast working speed.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Carpet extractor for cleaning a carpeted surface comprising, in combination: a chassis movably supported on the carpeted surface; means for propelling the chassis at first and second working speeds, with the first working speed being slower than the second working speed; first means for selecting one of the first and second working speeds; a carpeted surface agitator carried by the chassis; a clean solution tank for containing clean solution carried by the chassis, with the clean solution being capable of being dispensed to the carpeted surface at high and low solution flow rates, with the high solution flow rate being greater than the low solution flow rate; second means for selecting one of the high and low solution flow rates; a dirty solution tank carried by the chassis; and means for picking up solution off the carpet surface for collection in the dirty solution tank, with the carpet extractor being operable in both a restorative cleaning mode or a maintenance cleaning mode depending upon the selection of the high and low solution flow rates and the first and second working speeds.

2. The carpet extractor of claim 1 with the clean solution being dispensed upon the carpeted surfaced before the agitator at the high solution flow rate and being dispensed upon the agitator at the low solution flow rate for introduction to the carpeted surface by the agitator.

3. The carpet extractor of claim 2 with the agitator comprising a cylindrical brush rotated about an axis parallel to and spaced from the carpeted surface.

4. The carpet extractor of claim 3 with the clean solution being dispensed by a pump operating at a constant rate through a first dispensing line having at least one restorative nozzle allowing the high solution flow rate and a second dispensing line having at least one maintenance nozzle restricting dispensing of the clean solution to the low solution flow rate; and with the second means comprising a valve receiving clean solution from the pump and directing the clean solution to only one of the first and second dispensing lines.

5. The carpet extractor of claim 4 with the valve being manually actuated.

6. The carpet extractor of claim 5 with the second means being manually actuated.

7. The carpet extractor of claim 6 with the picking up means comprising a vacuum shoe in fluid communication with the dirty solution tank.

8. The carpet extractor of claim 7 with the chassis being movably supported by wheels and further including a handle for manipulation by an operator walking adjacent the chassis.

9. The carpet extractor of claim 1 with the clean solution being dispensed by a pump operating at a constant rate through a first dispensing line having at least one restorative nozzle allowing the high solution flow rate and a second dispensing line having at least one maintenance nozzle restricting dispensing of the clean solution to the low solution flow rate; and with the second means comprising a valve receiving clean solution from the pump and directing the clean solution to only one of the first and second dispensing lines.

10. The carpet extractor of claim 9 with the valve being manually actuated.

11. The carpet extractor of claim 10 with the second means being manually actuated.

12. Method for cleaning carpeted surfaces comprising:

providing a carpet extractor comprising, in combination: a chassis movably supported on the carpeted surface; means for propelling the chassis at first and second working speeds, with the first working speed being slower than the second working speed; first means for selecting one of the first and second working speeds; a carpeted surface agitator carried by the chassis; a clean solution tank for containing clean solution carded by the chassis, with the clean solution being capable of being dispensed to the carpeted surface at high and low solution flow rates, with the high solution flow rate being greater than the low solution flow rate; second means for selecting one of the high and low solution flow rates; a dirty solution tank carried by the chassis; and means for picking up solution off the carpet surface for collection in the dirty solution tank, with the carpet extractor being operable in both a restorative cleaning mode or a maintenance cleaning mode depending upon the selection of the high and low solution flow rates and the first and second working speeds;

selecting the dispensing of clean solution to the carpeted surface at either of the high and low solution flow rates, with the clean solution being dispensed at the selected flow rate;

agitating the carpeted surface including the dispensed clean solution with the carpeted surface agitator;

picking up the solution off the carpeted surface with the solution picking up means after the carpeted surface has been agitated with the carpeted surface agitator; and selecting either the first and second working speeds, with the chassis being propelled at the selected working speed, with the carpeted surface being restorative or maintenance cleaned depending upon the selection of the high and low solution flow rates and the first and second working speeds to clean the carpeted surface.

* * * * *

UNITED STATES PATENT AND TRADEMARK OFFICE

CERTIFICATE OF CORRECTION

PATENT NO. : 6,684,452 B2
DATED : February 3, 2004
INVENTOR(S) : Dexter Lehman et al.

It is certified that error appears in the above-identified patent and that said Letters Patent is hereby corrected as shown below:

Title page,
Item [56], References Cited, U.S. PATENT DOCUMENTS, add:

| | | |
|---|---|---|
| -- 3,559,230 | 02/1971 | Ogle |
| 4,006,506 | 02/1977 | Burgoon |
| 4,369,544 | 01/1983 | Parisi |
| 4,709,442 | 12/1987 | Sletten II |
| 4,819,676 | 04/1989 | Blehert et al. |
| 4,956,891 | 09/1990 | Wulff |
| 5,093,955 | 03/1992 | Blehert et al. |
| 5,455,982 | 10/1995 | Armstrong et al. |
| 5,829,095 | 11/1998 | Legatt et al. -- |

FOREIGN PATENT DOCUMENTS, add:

| | | |
|---|---|---|
| -- WO 8404663 | 12/1984 | Postonen |
| WO 8808269 | 11/1988 | Notetry Limited |
| WO 9428779 | 12/1994 | Henkel-Ecolab GmbH & Co. |
| WO 9639913 | 12/1996 | O.C. Product Development |
| DE 19510340 | 11/1996 | Nilfisk Schwamborn |
| DE 2139156 | 02/1973 | Paul Andrae |
| EP 0784958 | 07/1997 | Lux Deutschland |
| EP 0300637 | 09/1992 | Vax Appliances -- |

OTHER DOCUMENTS, add:
-- Convertamatic Models 32 B, 32BD, 38 BD, Parts List 042 059, Ser. No. 878 509, rev. Mar. 1982 Advance Machine Company, Spring Park, Minn. 55384 USA Convertamatic Model 260B, Parts List for machines after Ser. No. 776 159, © Advance Machine Co. Advance Machine Company, Spring Park, Minn. 55384-0275

Convertamatic Model 21B, Parts List for machines after Ser. No. 059 180, © 1985 Advance Machine Co. Advance Machine Company, Spring Park, Minn. 55384-0275

Aquaclean Model 262500, Parts List for machines after Ser. No. 359336, © 1989 Advance Machine Co. Advance Machine Company, Plymouth Minn. 8 55447-3408 --

UNITED STATES PATENT AND TRADEMARK OFFICE

CERTIFICATE OF CORRECTION

PATENT NO. : 6,684,452 B2
DATED : February 3, 2004
INVENTOR(S) : Dexter Lehman et al.

It is certified that error appears in the above-identified patent and that said Letters Patent is hereby corrected as shown below:

Column 7,
Line 23, please delete "carded" and substitute therefor -- carried --.

Signed and Sealed this

Eighth Day of June, 2004

JON W. DUDAS
*Acting Director of the United States Patent and Trademark Office*